US007651184B2

(12) United States Patent
Nakamura et al.

(10) Patent No.: US 7,651,184 B2
(45) Date of Patent: Jan. 26, 2010

(54) LIQUID DROPLET EJECTING APPARATUS

(75) Inventors: Hirotake Nakamura, Nagoya (JP); Takamasa Usui, Ogaki (JP); Naoya Okazaki, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 133 days.

(21) Appl. No.: 12/039,521

(22) Filed: Feb. 28, 2008

(65) Prior Publication Data

US 2008/0204506 A1 Aug. 28, 2008

(51) Int. Cl.
*B41J 29/38* (2006.01)
*B41J 2/175* (2006.01)

(52) U.S. Cl. ..... 347/6; 347/85

(58) Field of Classification Search ..... 347/6, 347/85

See application file for complete search history.

(56) References Cited

U.S. PATENT DOCUMENTS 5,485,187 A * 1/1996 Okamura et al. ..... 347/85
6,193,355 B1 2/2001 Nakamura
6,609,780 B2 8/2003 Sugiyama
2002/0196312 A1* 12/2002 Ishizawa et al. ..... 347/50
2004/0017422 A1* 1/2004 Katsuumi ..... 347/30
2004/0196339 A1* 10/2004 Kobayashi et al. ..... 347/85
2006/0132554 A1* 6/2006 Ota et al. ..... 347/85
2007/0229572 A1* 10/2007 Nishida ..... 347/19

FOREIGN PATENT DOCUMENTS

JP H11-058787 A 3/1999
JP 2001-071524 A 3/2001
JP 2003-019808 A 1/2003
JP 2007-030370 A 2/2007

* cited by examiner

*Primary Examiner*—Julian D Huffman
(74) *Attorney, Agent, or Firm*—Baker Botts L.L.P.

(57) ABSTRACT

A liquid droplet ejecting apparatus comprises an ejecting head including a passage which is connected to a sub-tank and an ejecting pressure applying device which applies a feed pressure to the liquid inside the passage, a main tank detector which detects that a main tank is mounted to a main tank mounting portion, a suction pump which applies a negative pressure to an air layer inside the sub-tank to discharge air from inside the sub-tank to outside, and a controller configured to control the suction pump and the ejecting pressure applying device, based on information from the main tank detector. The controller causes the suction pump to discharge the air from inside the sub-tank to outside and causes the ejecting pressure applying device to eject the liquid from a nozzle, when the main tank detector detects that the main tank is mounted to the main tank mounting portion.

9 Claims, 6 Drawing Sheets

LIQUID DROPLET EJECTING APPARATUS

CROSS-REFERENCE TO RELATED APPLICATION

This application claims the benefit of Japanese Patent Application No. 2007-050676, filed Feb. 28, 2007, the disclosure of which is incorporated herein by reference.

TECHNICAL FIELD

The present invention relates to a liquid droplet ejecting apparatus such as an ink jet printer.

BACKGROUND ART

Conventionally, an ink jet printer has been known, in which ink droplets are ejected from an ejecting head onto recording paper to print an image on the recording paper (see Japanese Laid-Open Patent Application Publication No. 2007-30370, for example). In this ink jet printer, ink is supplied through an ink supply tube from a main tank of a cartridge type to a sub-tank provided integrally with the ejecting head, and is supplied appropriately from the sub-tank to the ejecting head.

In the above described conventional ink jet printer, if air exists in the ink supply tube, ink ejecting failure of the ejecting head is likely to occur. In order to inhibit the air from being suctioned into the ink supply tube, an alarm inducing ink change is output a little time before the ink inside the main tank has been consumed and the main tank becomes empty. This brings about waste ink. It is therefore desirable to consume the whole ink inside the main tank and to discharge the air existing in the ink supply tube so as not to reach the ejecting head. To this end, a suction pump applies a negative pressure to an air layer inside the sub-tank to discharge the air so that the air existing in the ink supply tube is guided together with the ink to the sub-tank and is separated from the ink therein. Thus, the air can be discharged to outside.

However, when the suction pump applies the negative pressure to the air layer inside the sub-tank in a case where a liquid level of the ink inside the sub-tank is high, the liquid level of the ink inside the sub-tank may immediately reach an upper limit because the ink is suctioned together with the air by the suction pump, and the suction pump may stop suctioning in the state where the air still remains within the ink supply tube.

SUMMARY OF THE INVENTION

The present invention has been developed under the circumstances, and an object of the present invention is to provide a liquid droplet ejecting apparatus which is capable of surely discharging air existing in a liquid supply passage extending from a main tank to a sub-tank.

According to the present invention, there is provided a liquid droplet ejecting apparatus comprising a main tank mounting portion to which a main tank for storing liquid is removably mounted; a sub-tank which is connected to a main tank in a state where the main tank is mounted to the main tank mounting portion; an ejecting head including a passage which is connected to the sub-tank to guide liquid delivered from the sub-tank to a nozzle and an ejecting pressure applying device which applies a feed pressure to the liquid inside the passage toward the nozzle to eject the liquid from the nozzle; a main tank detector which detects that the main tank is mounted to the main tank mounting portion; a suction pump which applies a negative pressure to an air layer inside of the sub-tank to discharge air from inside the sub-tank to outside; and a controller configured to control the suction pump and the ejecting pressure applying device, based on information from the main tank detector; wherein the controller causes the suction pump to discharge the air from inside the sub-tank to outside and causes the ejecting pressure applying device to eject the liquid from the nozzle, when the main tank detector detects that the main tank is mounted to the main tank mounting portion.

In such a configuration, a liquid level inside the sub-tank which is going to increase when the suction pump applies a negative pressure to the air layer inside the sub-tank to suction the liquid together with the air, is intentionally lowered by the liquid ejecting operation performed by the ejecting head. Therefore, the liquid level inside the sub-tank does not reach an upper limit, and thus the air existing in an air supply passage extending from the main tank to the sub-tank can be surely discharged.

The liquid droplet ejecting apparatus may further comprise a liquid supply tube through which the main tank and the sub-tank are connected to each other; and the controller may be configured to drive the ejecting pressure applying device to eject the liquid with an amount less than an entire volume of an interior of the liquid supply tube.

In such a configuration, since the air equal in amount to at least a part of the entire volume of the interior of the liquid supply tube is discharged by the suction pump, the ejecting head is controlled to eject the liquid with the amount less than the entire volume of the interior of the liquid supply tube. Thereby, the waste ink can be reduced.

The liquid droplet ejecting apparatus may further comprise a liquid supply tube through which the main tank and the sub-tank are connected to each other, and the controller may be configured to drive the suction pump to be able to discharge to outside air with an amount equal to an entire volume of an interior of the liquid supply tube.

In such a configuration, in a case where the air increases within the liquid supply tube and occupies the entire volume of the interior of the liquid supply tube, for example, after a long-time unused state, the air can be surely released from the liquid supply tube.

The controller may be configured to drive the ejecting pressure applying device to eject the liquid with an amount less than the entire volume of the interior of the liquid supply tube.

The liquid droplet ejecting apparatus may further comprise a gas permeable film which is disposed in a passage between the sub-tank and the suction pump so as to block the passage, the gas permeable film permitting permeation of the air more easily than the liquid.

In such a configuration, even if the liquid level inside the sub-tank reaches the upper limit, the gas permeable film blocks the flow of the liquid into the suction pump. Therefore, a control process for stopping the suction pump to inhibit suctioning the liquid may be omitted, or otherwise a control process under precise conditions becomes unnecessary. As a result, the control process executed by the controller can be simplified.

The main tank may be a part of a plurality of main tanks mounted to the main tank mounting portion and the sub-tank may be a part of a plurality of sub-tanks respectively corresponding to the plurality of main tanks. The passage of the ejecting head may be a part of a plurality of passages respectively corresponding to the plurality of main tanks, and the ejecting pressure applying device may be able to selectively apply the feed pressure to the liquid within the plurality of passages. The suction pump may be connected to the plurality of sub-tanks. The controller may be configured to drive the ejecting pressure applying device to eject from the nozzle the liquid inside the sub-tank corresponding to the main tank which has been detected by the main tank detector to be mounted to the main tank mounting portion.

In such a configuration, since the suction pump is connected to the plurality of sub-tanks, a configuration of the apparatus can be simplified. In this case, although the negative pressure is applied to the sub-tank corresponding to the main tank which has not been changed yet and the liquid level thereof increases, the ejecting head does not eject the liquid. But, the semi-transparent film serves to block the liquid so that entry of the liquid into the suction pump can be surely inhibited.

The controller may be configured to start driving the ejecting pressure applying device after the controller starts driving the suction pump, when the main tank detector detects that the main tank is mounted to the main tank mounting portion.

In such a configuration, after the suction pump discharges the air from inside the sub-tank and thereby the liquid level thereof increases to some degree, the ejecting head starts ejecting the liquid to lower the liquid level. This makes it possible to reduce the liquid ejected to be discarded.

The liquid droplet ejecting apparatus may further comprise a feed device which passes recording medium through an ejecting area where the liquid is ejected from the nozzle. The controller may have a recording mode in which the ejecting pressure applying device causes the liquid to be ejected from the nozzle toward the recording medium when the feed device passes the recording medium through the ejecting area. The controller may be configured to control the ejecting pressure applying device to eject the liquid from the nozzle with a diameter larger than a diameter of droplets of the liquid ejected in the recording mode, when the main tank detector detects that the main tank is mounted to the main tank mounting portion.

In such a configuration, since a volume of each liquid droplet ejected from the ejecting head is larger in the air release operation than in the recording mode, the liquid level inside the sub-tank which increases due to the negative pressure generated by the suction pump can be lowered in a short time. Thus, the air release operation can be accomplished efficiently in a short time.

The controller may have a flushing mode in which the ejecting pressure applying device causes the liquid to be ejected forcibly from the nozzle. The controller may be configured to control the ejecting pressure applying device to eject the liquid from the nozzle with a diameter larger than a diameter of droplets of the liquid ejected in the flushing mode, when the main tank detector detects that the main tank is mounted to the main tank mounting portion.

In such a configuration, since a volume of each liquid droplet ejected from the ejecting head is larger in the air release operation than in the flushing mode, the liquid level inside the sub-tank which increases due to the negative pressure generated by the suction pump can be lowered in a short time. Thus, the air release operation can be accomplished efficiently in a short time.

The above and further objects and features of the invention will more fully be apparent from the following detailed description with accompanying drawings.

DETAILED DESCRIPTION OF THE PREFERRED EMBODIMENT

Hereinafter, an embodiment of the present invention will be described with reference to the drawings.

Figure 1:
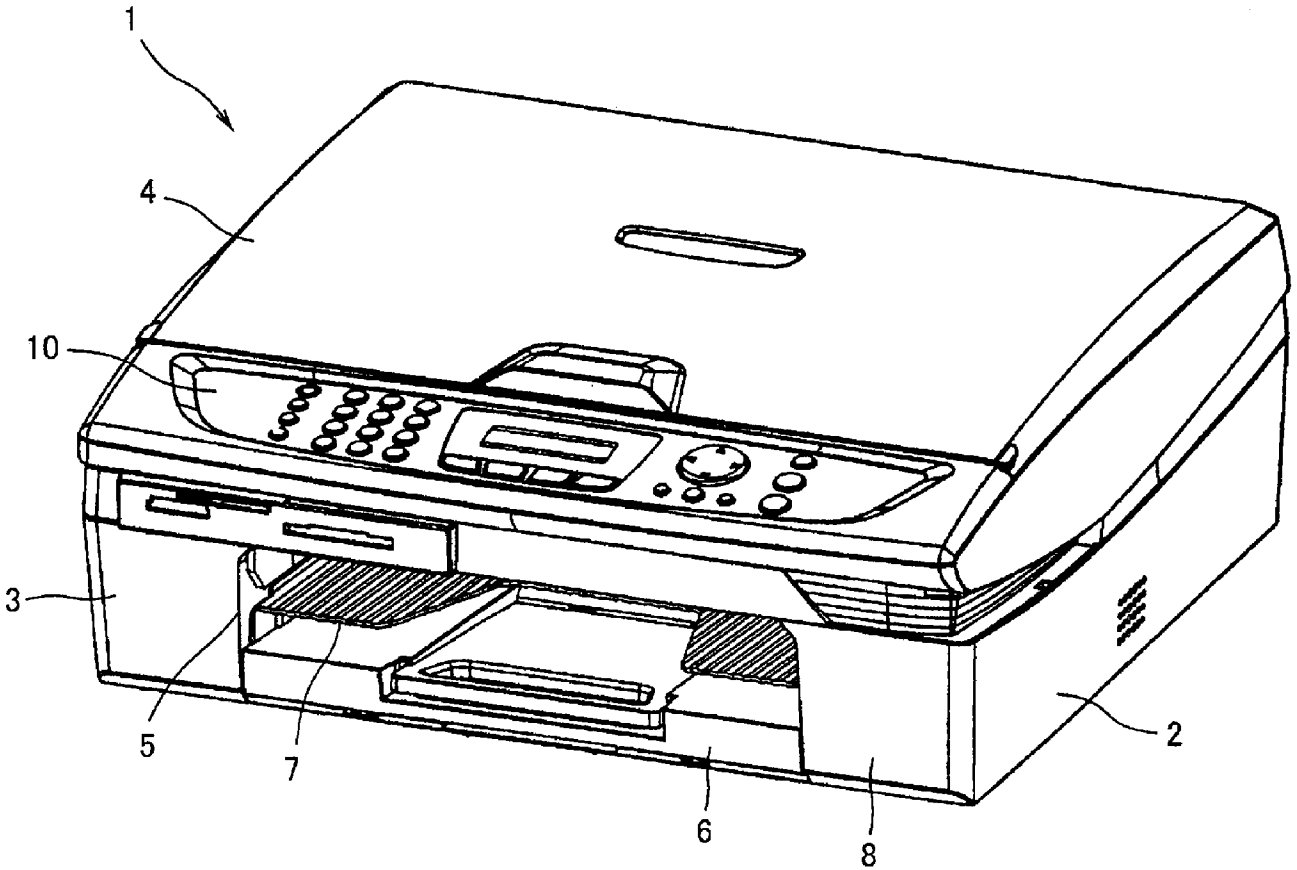
FIG. 1 is a perspective view of a complex machine including an ink jet printer according to an embodiment of the present invention.

FIG. 1 is a perspective view showing a complex machine 1 having an ink jet printer 3 (liquid droplet ejecting apparatus) according to the embodiment of the present invention. As shown in FIG. 1, the complex machine 1, which is capable of printing, scanning, copying, and facsimile transmission, has the ink jet printer 3 at a lower part of a casing 2, and a scanner 4 at an upper part of the casing 2. An opening 5 is provided on a front face of the casing 2. A paper supply tray 6 of the ink jet printer 3 is provided at a lower position of the opening 5 and a paper discharge tray 7 of the ink jet printer 3 is provided at an upper position of the opening 5. An openable lid 8 is provided at a right lower part of on the front face side of the ink jet printer 3. A main tank mounting portion 23 (see FIGS. 2 and 3) is provided inward of the openable lid 8. An operation panel 10 is provided at a front face side of an upper part of the complex machine 1 to enable the ink jet printer 3 and the scanner 4 to be operated by a user. The complex machine 1 is operable based on an instruction sent from an external personal computer (not shown) via a driver.

Figure 2:
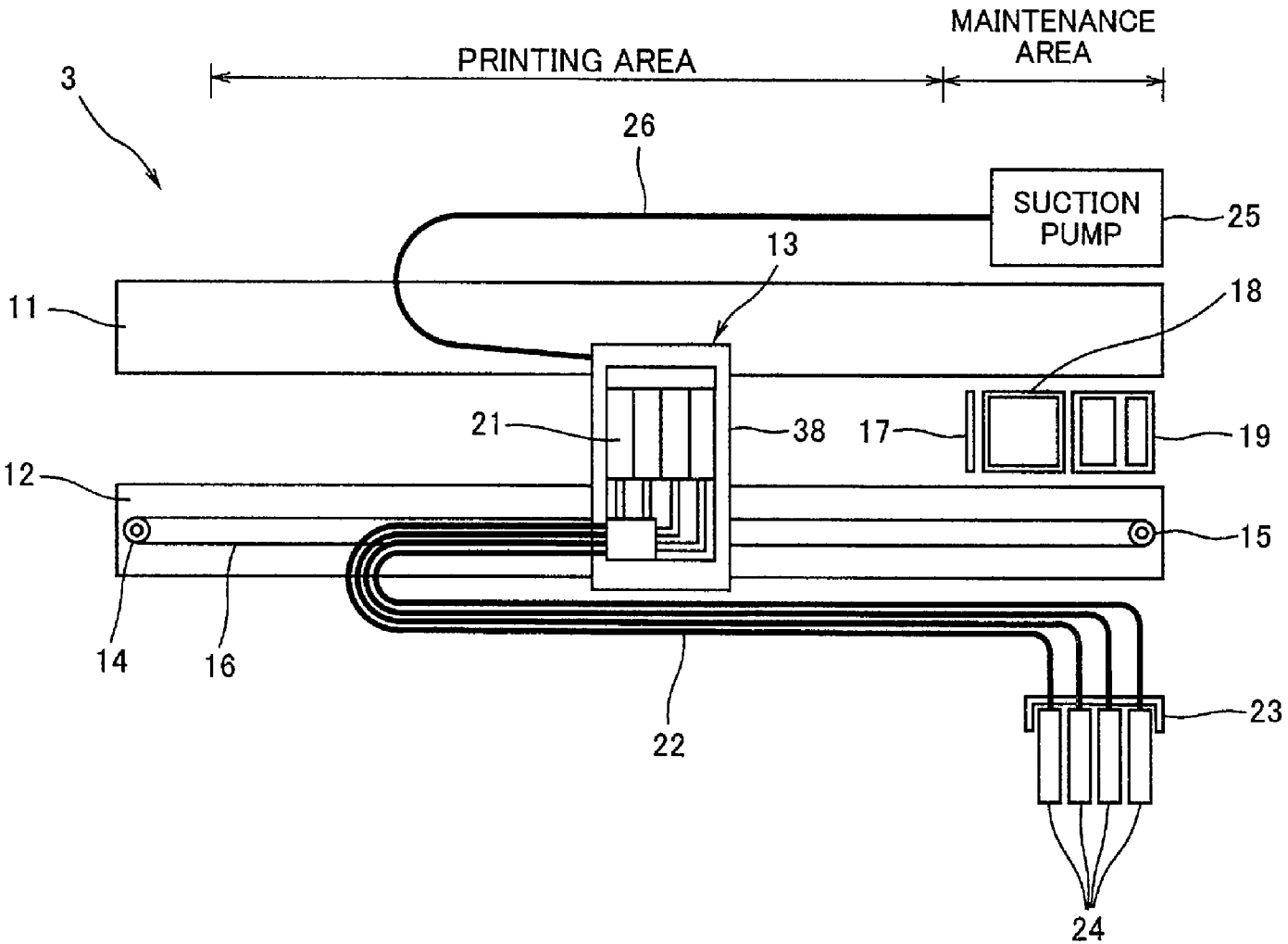
FIG. 2 is a plan view schematically showing the ink jet printer of FIG. 1.

FIG. 2 is a plan view showing a schematic construction of the ink jet printer 3 of FIG. 1. As shown in FIG. 2, the ink jet printer 3 has a pair of guide rails 11 and 12 extending substantially in parallel. An image recording unit 13 is mounted on the guide rails 11 and 12 so as to be slidable along the guide rails 11 and 12 in a scanning direction. The image recording unit 13 is coupled to a timing belt 16 installed around a pair of pulleys 14 and 15. The timing belt 16 extends substantially in parallel with the direction in which the guide rail 12 extends. A motor (not shown), which rotates clockwise or counterclockwise, is attached to the pulley 15. The motor causes the pulley 15 to rotate clockwise or counterclockwise to thereby cause the timing belt 16 to reciprocate so that the image recording unit 13 is scanned along the guide rails 11 and 12.

An area in which the image recording unit 13 reciprocates has a printing area 30 (ejecting area) (see FIG. 3) in which an image is recorded on recording paper 27 (see FIG. 3), and a maintenance area in which the image is not recorded. In the maintenance area, a wiping operation for wiping a nozzle surface which is a lower surface of the image recording unit 13, a flushing operation for ejecting the ink to fix up the nozzle surface which has been subjected to the wiping operation, a purging operation for suctioning dry ink or foreign matters from the nozzle under a negative pressure, are carried out. Between the pair of guide rails 11 and 12 in the maintenance area, a wiper blade 17, a waste ink receiver 18, and a suction cap 19 are arranged. Hereinafter, a control state in which the ink is forcibly ejected from the nozzles of the image recording unit 13 in a state where the recording paper 27 is not passing through the printing area 30, is referred to as a flushing mode.

The wiper blade 17 is driven by a wiper drive unit (not shown) to be movable up and down. The wiper blade 17 moves up when the image recording unit 13 moves from the printing area to the maintenance area, to perform the wiping operation for wiping the nozzle surface to remove the ink and others adhering onto the nozzle surface. The waste ink receiver 18 is disposed adjacent the wiper blade 17, and receives the ink ejected by flushing from the nozzle of the image recording unit 13. The suction cap 19 is disposed adjacent the waste ink receiver 18 and is applied with a purging negative pressure in a state where the suction cap 19 is in contact with the periphery of the nozzle surface of the image recording unit 13.

The image recording unit 13 has a carriage 38 which is a casing. Four sub-tanks 21 are provided at the carriage 38. The sub-tanks 21 are integral with each other but may be separate. The main tank mounting portion 23 is provided in a front position at a right side of the guide rail 12. Main tanks 24 of a cartridge type for four colors (black, cyan, magenta, yellow) are removably mounted to the main tank mounting portion 23. The main tanks 24 mounted to the main tank mounting portion 23 are respectively coupled to the sub-tanks 21 through ink supply tubes 22 forming liquid supply passages. A suction pump 25 is provided in a backward position at the right side of the guide rail 11. The suction tube 25 is coupled to the sub-tanks 21 through an air discharge tube 26.

Figure 3:
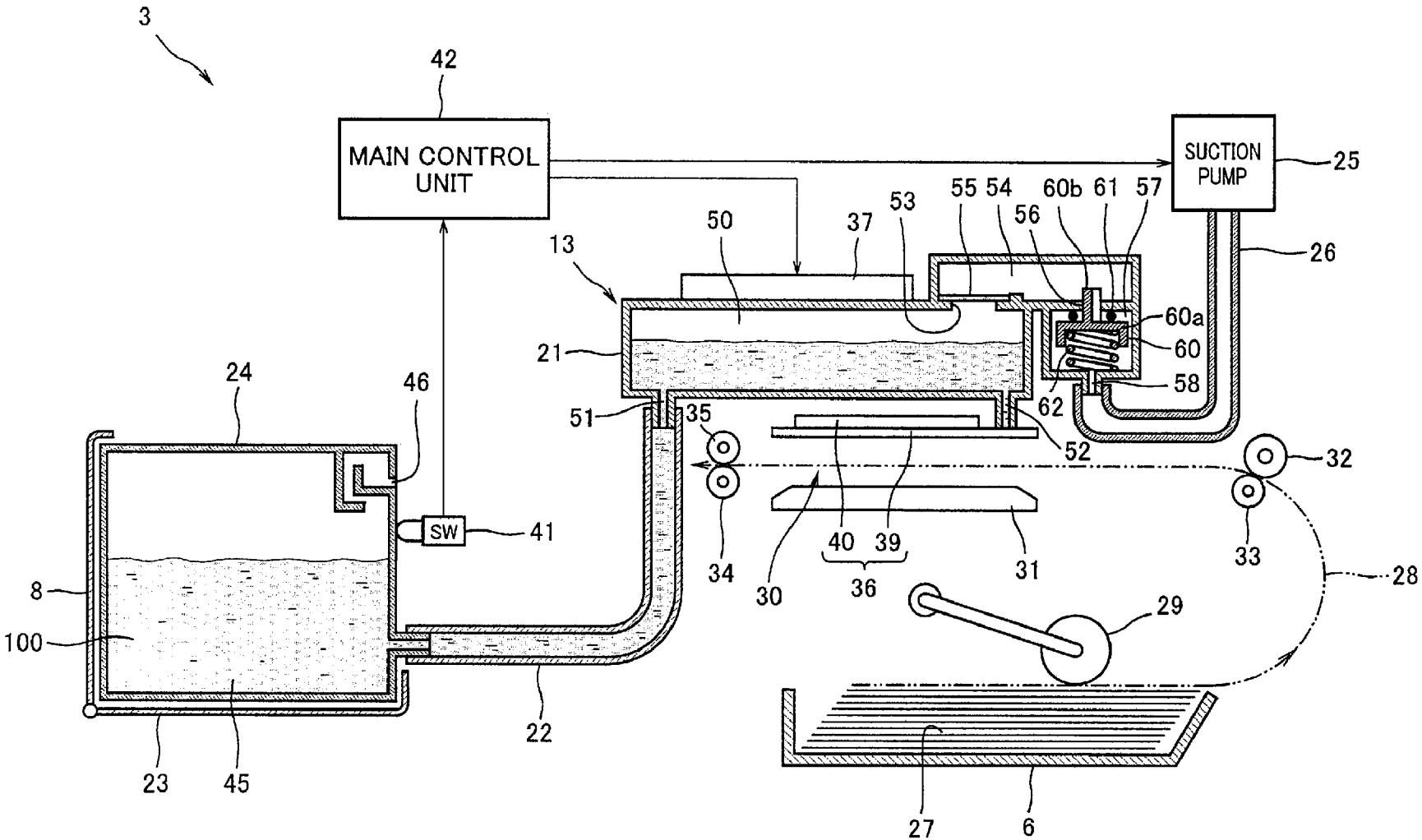
FIG. 3 is a partial cross-sectional view schematically showing the ink jet printer of FIG. 1.

FIG. 3 is a partial cross-sectional view schematically showing the ink jet printer 3 of FIG. 1. As shown in FIG. 3, a paper supply tray 6 is disposed on a bottom side of the ink jet printer 3. A paper supply drive roller 29 is provided on an upper side of the paper supply tray 6 to supply to a feed path 28 uppermost paper of the recording paper 27 (recording medium) stacked within the paper supply tray 6. The feed path 28 extends upward from a back surface side of the paper supply tray 6, then turns back toward the front face, and is guided to the paper discharge tray 7 (see FIG. 1) through the printing area 30.

A platen 31, which is larger than paper in size, is disposed under the image recording unit 13. A feed roller 32 and a pinch roller 33 (feed device) are provided upstream of the image recording unit 13 to squeeze the recording paper 27 being fed through the feed path 28 to a location above the platen 31. A paper discharge roller 34 and a pinch roller 35 are provided downstream of the image recording unit 13 to squeeze the recording paper 27 on which the image has been recorded and to feed it to the paper discharge tray 7 (see FIG. 1).

The image recording unit 13 includes the sub-tanks 21 for buffering which temporarily reserve ink 100, a known piezoelectric-driven ink jet head 36 (ejecting head) which ejects the ink 100 delivered from the sub-tanks 21 toward the platen 31 through a number of nozzles, and a head control board 37 which is coupled to the ink jet head 36 via a flexible wiring (not shown) to drive the ink jet head 36. The ink jet head 36 includes a passage unit 39 having a plurality of passages (not shown) through which the ink 100 delivered from the sub-tanks 21 is guided to a plurality of nozzles (not shown), and a piezoelectric actuator 40 (ejecting pressure applying device) which selectively applies a feed pressure to the ink 100 within the passages of the passage unit 39 toward the nozzles.

Each main tank 24 has an ink reserving chamber 45, and an air hole 46 through which the ink reserving chamber 45 communicates with outside. In the state where the main tank 24 is mounted to the main tank mounting portion 23, the ink reserving chamber 45 is connected to an ink reserving chamber 50 of the sub-tank 21 through the ink supply tube 22. The ink jet printer 3 is attached with a main tank detecting switch 41 (main tank detector) which detects that the main tank 24 is mounted to the main tank mounting portion 23. The main tank detecting switch 41 is coupled to a main control unit 42 (controller). The main control unit 42 is configured to send a control signal to the suction pump 25 and to the head control board 37 based on a signal received from the main tank detecting switch 41. To be more specific, the main control unit 42 includes a CPU, memories such as a ROM which contains programs being run by the CPU and data used for the programs, a RAM which temporarily stores the data when the programs are being run, and an EEPROM which is rewritable data, an input/output interface, etc. The main control unit 42 executes control for an air-release operation performed when the main tank 42 is changed, which will be described later. In addition, the main control unit 42 executes control for operations of the ink jet printer 3, such as paper supply and discharge operation of the recording paper 27, a scanning operation of the image recording unit 13, and an ink ejecting operation for printing. Hereinafter, a control state in which the main control unit 42 causes the feed roller 32 and the pinch roller 33 to pass the recording paper 27 through the printing area 30 (ejecting area) so that ink droplets are ejected from the ink jet head 36 toward the recording paper 27, is referred to as a recording mode, as described later.

Each sub-tank 21 has therein the ink reserving chamber 50. An inlet 51 is provided at one side of a bottom wall portion of the sub-tank 21 and is connected to the ink supply tube 22, and an outlet 52 is provided at the other side of the bottom wall portion of the sub-tank 21 and is connected to the passage within the passage unit 39. An air discharge hole 53 is provided at a part of an upper wall portion of the sub-tank 21. The sub-tank 21 has an air discharge chamber 54 connected to the ink reserving chamber 50 through the air discharge hole 53. The air discharge hole 53 is closed by a semi-transparent film 55 which is a gas impermeable film which permits permeation of air but does not permit permeation of the ink. The semi-transparent film 55 is made of, for example, a highly liquid-impermeable film material that has minute holes. An air discharge valve chamber 57 is connected to the air discharge chamber 54 through a connecting hole 56.

An air discharge valve 60 is provided within the air discharge chamber 57 and is able to open and close the connecting hole 56. The air discharge valve 60 includes a spring seat portion **60*a*, and a shaft portion 60*b* which protrudes upward from the spring seat portion 60*a* and is inserted into the connecting hole 56. The spring seat portion 60*a* has a clearance between the spring seat portion 60*a* and an inner side surface of the air discharge valve chamber 57 so that an upper space and a lower space with the spring seat portion 60*a* interposed therebetween communicate with each other through the clearance. The shaft portion 60*b* has a groove forming a clearance between the shaft portion 60*b* and an inner peripheral surface of the connecting hole 56 so that an upper space and a lower space with the connecting hole 56** interposed therebetween communicate with each other through the clearance.

A seal ring 61 is attached around the connecting hole 56 on an inner peripheral surface of the air discharge valve chamber 57. A coil spring 62 is mounted on the air discharge valve 60 to apply a force to the spring seat portion **60*a* toward the seal ring 61. A suction port 58 is provided on a lower wall portion of the air discharge valve chamber 57. One end portion of the air discharge tube 26 is coupled to the suction port 58 and the other end portion of the air discharge tube 26 is coupled the suction pump 25**. In this construction, when the suction pump 25 applies a negative pressure to the air discharge valve chamber 57 via the air discharge tube 26 and the suction port 58, the air discharge valve 60 moves away from the seal ring 61 against the coil spring 62, enabling the connecting hole 56 to be opened. Thereby, the negative pressure within the air discharge valve chamber 57 is transmitted to the air discharge chamber 54, and further to the ink reserving chamber 50 via the semi-transparent film 55.

Figure 4:
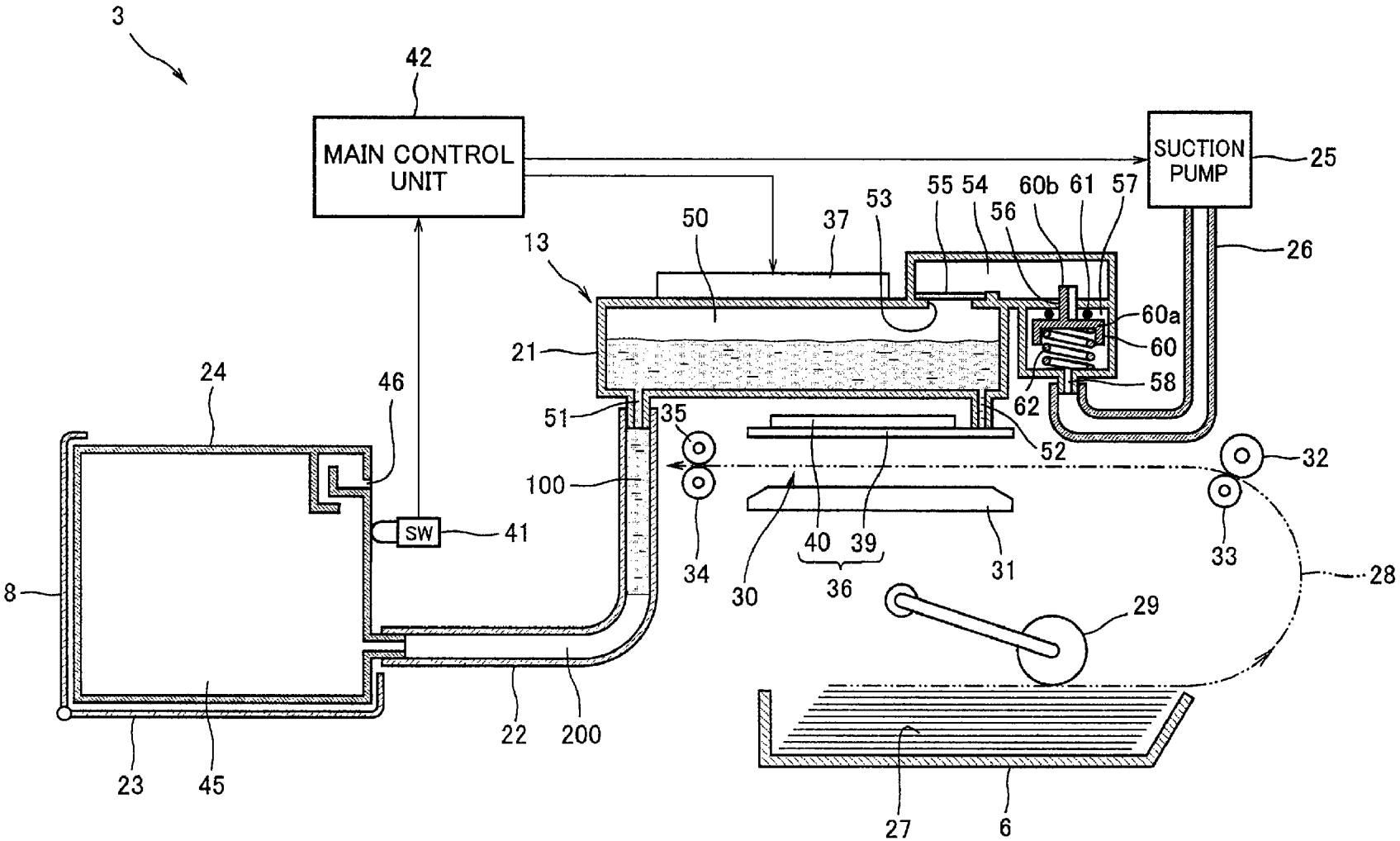
FIG. 4 is a partial cross-sectional view showing a state where there is no ink in a main tank of the ink jet printer of FIG. 1.

Subsequently, the air release operation of the ink jet printer 3 performed when the main tank 24 is changed will be described with reference to FIGS. 4 to 6. FIG. 4 is a partial cross-sectional view showing a state where there is no ink inside the main tank 24 of the ink jet printer 3 of FIG. 1. As shown in FIG. 4, the ink jet printer 3 is configured to consume the ink by printing until the ink reserving chamber 45 of the main tank 24 becomes empty. The ink jet head 36 performs the ink ejecting operation until the whole ink inside the main tank 24 corresponding to one color has been consumed, so that air 200 flows from the main tank 24 into the ink supply tube 22. In this state, if the user changes the main tank 24 with new one, then the air 200 remains within the ink supply tube 22. Therefore, the main control unit 42 executes the air release operation for releasing the air 200 as described below.

Figure 5:
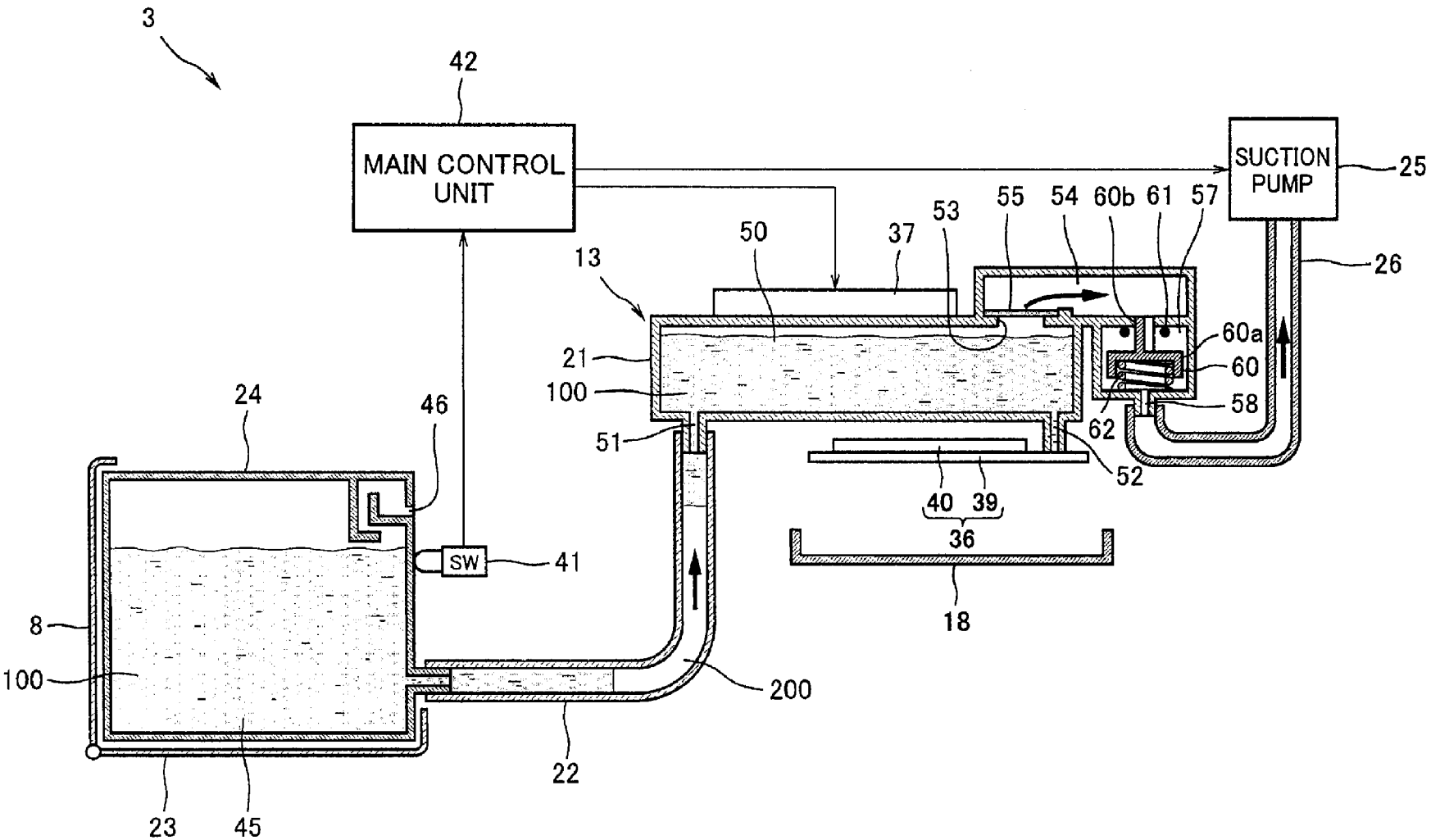
FIG. 5 is a partial cross-sectional view showing a first sep of an air release operation performed when the main tank of the ink jet printer of FIG. 1 is changed.

FIG. 5 is a partial cross-sectional view showing a first step of the air release operation of the ink jet printer 3 performed when the main tank 24 is changed. As shown in FIG. 5, when the main tank 24 is changed, the image recording unit 13 is controlled to be positioned directly above the waste ink receiver 18. When a new main tank 24 is mounted to the main tank mounting portion 23, a wall surface of the main tank 24 presses the main tank detecting switch 41, which sends a signal to the main control unit 42, which detects based on the signal that an old main tank 24 has been changed with the new main tank 24. Then, the main control unit 42 starts driving the suction pump 25. When the suction pump 25 is driven, a negative pressure is generated in the air discharge tube 26 and the air discharge valve 60 opens the connecting hole 56 against the coil spring 82. Thereby, the negative pressure is transmitted from the suction pump 25 to the ink reserving chamber 50 of the sub-tank 21 through the semi-transparent film 55.

Therefore, air in an upper layer inside the ink reserving chamber 50 of the sub-tank 21 is suctioned by the suction pump 25, permeates the semi-transparent film 55, and is discharged to outside. According to this air discharge, the ink flows from the ink supply tube 22 into the ink reserving chamber 50 of the sub-tank 21, so that a liquid level of the ink 100 inside the sub-tank 21 increases. Accordingly, the main control unit 42 causes the ink jet head 36 to start the ink ejecting operation with a delay of several seconds from when the main control unit 42 starts driving the suction pump 25. While the suction pump 25 is driven, the negative pressure is also generated in the sub-tank 21 corresponding to the main tank 24 which is not changed with new one yet and a liquid level thereof increases. However, the ink is blocked at the semi-transparent film 55 to inhibit it from flowing into the suction pump 25.

Figure 6:
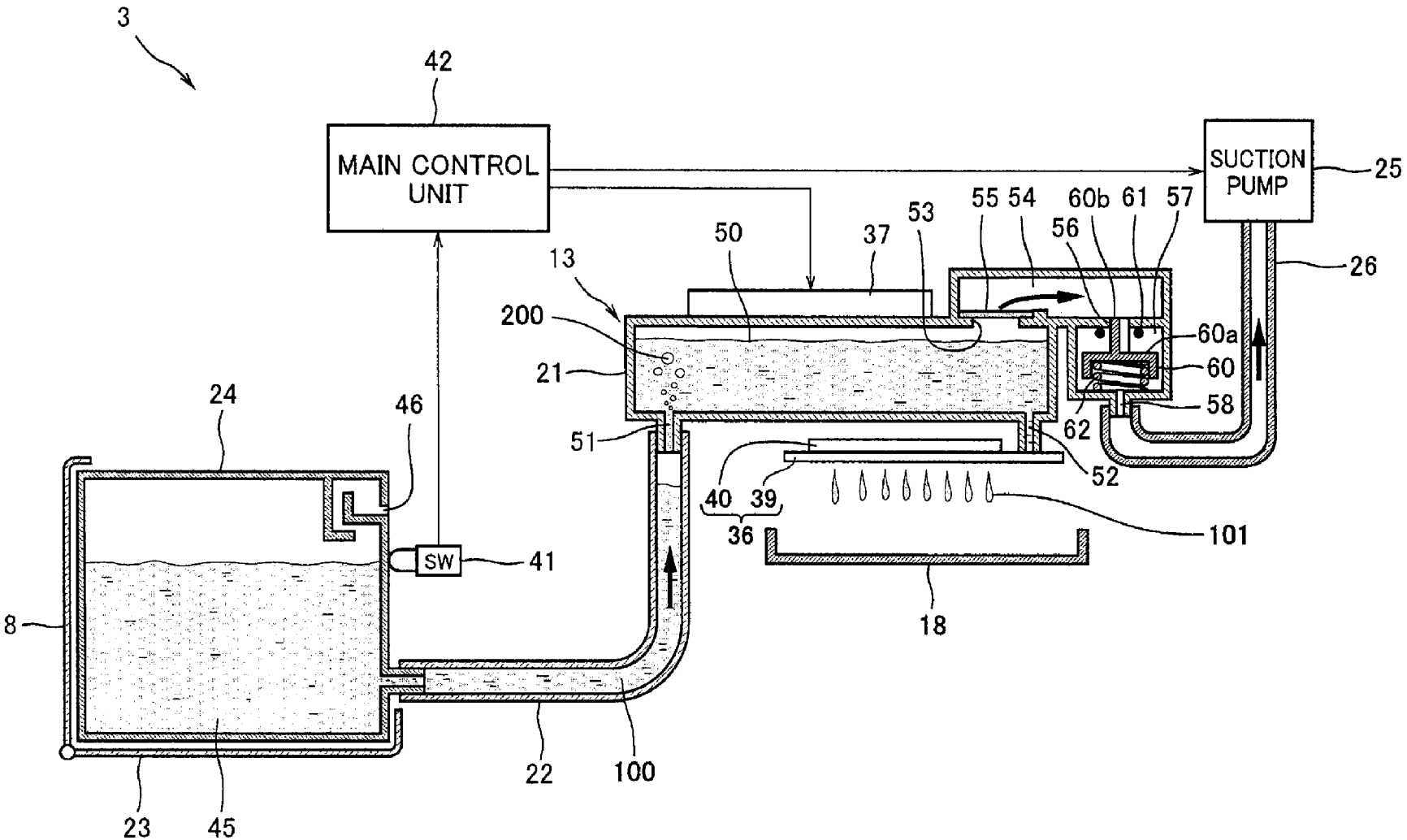
FIG. 6 is a partial cross-sectional view showing a second sep of an air release operation performed when the main tank of the ink jet printer of FIG. 1 is changed.

FIG. 6 is a partial cross-sectional view showing a second step of the air release operation of the ink jet printer 3 performed when the main tank 24 is changed. As shown in FIG. 6, the main control unit 24 sends a command to the head control board 37 so that the ink jet head 36 performs the ink ejecting operation for the color corresponding to the changed main tank 24, with a delay of several seconds from when the main control unit 24 starts driving the suction pump 25. In response to the command, the head control board 37 drives the piezoelectric actuator 40 to eject ink droplets 101 of the color corresponding to the changed main tank 24 toward the waste ink receiver 18 through the nozzle of the passage unit 39. Thereby, the liquid level of the ink inside the ink reserving chamber 50 of the sub-tank 21 is lowered and does not contact the semi-transparent film 55. Under this condition, the air discharge from the ink reserving chamber 50 can continue.

In the air release operation, the main control unit 42 sends a command to the head control board 37 so that the ink jet head 36 ejects the ink with a diameter which is larger than a diameter of droplets of the ink ejected in the above described recording mode and a diameter of droplets of the ink ejected in the above described flushing mode. To be more specific, the diameter of droplets of the ink ejected in the recording mode is changeable according to a printing resolution, etc. When the air release operation is carried out in association with the change of the main tank 24, the ink is ejected from the ink jet head 36 with the diameter which is larger than a largest diameter of droplets of the ink ejected in the recording mode and is larger than the diameter of droplets of the ink ejected in the flushing mode. To make the diameter of droplets of the ink ejected in the air release operation larger than the diameter of droplets of the ink ejected in the recording mode and the diameter of droplets of the ink ejected in the flushing mode, to be specific, the piezoelectric actuator 40 is caused to increase the pressure applied to the passage of the passage unit 39, or to change timings when the pressure is applied. Alternatively, the diameter of droplets of the ink ejected from the ink jet head 36 in the air release operation in association with the change of the main tank 24 need not be larger than the largest diameter of droplets of the ink ejected in the recording mode, so long as the diameter in the air release operation is larger than the diameter in the flushing mode. The main control unit 42 drives the piezoelectric actuator 40 for a preset time period when the ink with an amount less than an entire volume of the interior of the ink supply tube 22 is ejected from the nozzle of the passage unit 39, and stops the piezoelectric actuator 40 after a lapse of the preset time period. In addition, the main control unit 42 drives the suction pump 25 for a preset time period when air equal in amount to the entire volume of the interior of the ink supply tube 22 is discharged to outside, and stops the suction pump 25 after a lapse of the preset time period. In this case, the piezoelectric actuator 40 may be stopped earlier than the suction pump 25, or the piezoelectric actuator 40 and the suction pump 25 may be stopped at the same time.

In accordance with the above described configuration, even though the liquid level of the ink inside the sub-tank 21 increases and comes close to the semi-transparent film 55 when suction pump 25 applies the negative pressure to the air inside the sub-tank 21, and suctions the ink 100 together with the air, the ink jet head 36 performs the ink ejecting operation to intentionally lower the liquid level of the ink inside the sub-tank 21. This makes it possible to inhibit the liquid level of the ink inside the sub-tank 21 from reaching the semi-transparent film 55. As a result, the air 200 can be surely discharged from the ink supply tube 22.

In addition, since the ink jet head 36 is controlled to eject the ink with the amount less than the entire volume of the interior of the ink supply tube 22 considering that the suction pump 25 performs suctioning to discharge from the ink supply tube 22 the air equal in amount to at least a part of the entire volume of the interior of the ink supply tube 22, the waste ink which is discarded to lower the liquid level inside the sub-tank 21 can be reduced. Furthermore, since the suction pump 25 is controlled to be able to discharge to outside the air equal in amount to the entire volume of the interior of the ink supply tube 22, the entire air can be released surely from the ink supply tube 22 even if the air is increased within the ink supply tube 22 and occupies the interior of the ink supply tube 22.

Since the air discharge hole 53 of the ink reserving chamber 50 of the sub-tank 21 is closed by the semi-transparent film 55, the ink is inhibited from flowing into the air discharge chamber 54 even if the liquid level of the ink inside the sub-tank 21 reaches the air discharge hole 53 which is the upper limit of the liquid level. This eliminates a need for the main control unit 42 to stop the suction pump 25 to inhibit suctioning. Thus, the control process executed by the main control unit 42 is simplified.

Since the main control unit 42 starts driving the piezoelectric actuator 40 later than the suction pump 25, the ink jet head 36 starts ejecting the ink droplets 101 at the time when the air has been discharged from the sub-tank 21 by the suction pump 25 and the liquid level inside the sub-tank 21 has been increased up to some degree. This makes it possible to reduce the amount of the waste ink which is discarded to lower the liquid level inside the sub-tank 21. Furthermore, since the diameter of droplets of the ink ejected in the air release operation is larger than that of droplets of the ink ejected in the recording mode and that of droplets of the ink ejected in the flushing mode, and a volume of each ink droplet ejected from the ink jet head 36 is larger than that in the recording mode, the liquid level of the ink inside the sub-tank 21 which increases due to the negative pressure generated by the suction pump 25 can be lowered in a short time. Thus, the air release operation can be accomplished efficiently in a short time.

Whereas in the above described embodiment, the main control unit 42 starts driving the piezoelectric actuator 40 with a delay time after it starts driving the suction pump 25, when the main tank detecting switch 41 detects that the main tank 24 is mounted to the main tank mounting portion 23, it may alternatively start driving the piezoelectric actuator 40 and the suction pump 25 at the same time.

Whereas in the above described embodiment, the air discharge hole 53 of the ink reserving chamber 50 is closed by the semi-transparent film 55 which permits permeation of the air but does not permit permeation of the ink, the semi-transparent film 55 may be omitted. In that case, it is necessary to start driving the piezoelectric actuator 40 immediately after or at the same time when the suction pump 25 has been driven, upon detecting that the main tank 42 has been changed. Furthermore, the piezoelectric actuator 40 must be driven so as to increase a feed pressure applied to the ink within the passage of the passage unit 39 to direct the ink toward the nozzle so that the ink is ejected from the nozzle with a relatively large amount so as not to leak from the ink reserving chamber 50 to the air discharge chamber 54.

Whereas in the above described embodiment, the air discharge hole 55 is closed by the semi-transparent film 55 which permits permeation of the air but does not permit permeation of the ink, it alternatively may be closed by other suitable films which permit permeation of the air more easily than liquid, or which permit permeation of small amount of ink, for example, mesh-like film for filtering the liquid to remove minute foreign matters contained in the liquid. In that case, also, it is desirable to control driving timings and a driving force of the piezoelectric actuator 40 in order to inhibit the ink from leaking from the ink reserving chamber 50 to the air discharge chamber 54. But, the control process need not be executed so precisely as a case where the film is omitted.

Whereas in the above described embodiment, the present invention is applied to the ink jet printer, it is applicable to other liquid droplet ejecting apparatus which ejects liquid other than the ink.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A liquid droplet ejecting apparatus comprising:

a main tank mounting portion to which a main tank for storing liquid is removably mounted;

a sub-tank which is connected to a main tank in a state where the main tank is mounted to the main tank mounting portion;

an ejecting head including a passage which is connected to the sub-tank to guide the liquid delivered from the sub-tank to a nozzle and an ejecting pressure applying device which applies a feed pressure to the liquid inside the passage toward the nozzle to eject the liquid from the nozzle;

a main tank detector which detects that the main tank is mounted to the main tank mounting portion;

a suction pump which applies a negative pressure to an air layer inside the sub-tank to discharge air from inside the sub-tank to outside; and a controller configured to control the suction pump and the ejecting pressure applying device, based on information from the main tank detector;

wherein the controller causes the suction pump to discharge the air from inside the sub-tank to outside and causes the ejecting pressure applying device to eject the liquid from the nozzle, when the main tank detector detects that the main tank is mounted to the main tank mounting portion.

2. The liquid droplet ejecting apparatus according to claim 1, further comprising:

a liquid supply tube through which the main tank and the sub-tank are connected to each other; wherein the controller is configured to drive the ejecting pressure applying device to eject the liquid with an amount less than an entire volume of an interior of the liquid supply tube.

3. The liquid droplet ejecting apparatus according to claim 1, further comprising:

a liquid supply tube through which the main tank and the sub-tank are connected to each other; wherein the controller is configured to drive the suction pump to be able to discharge to outside air with an amount equal to an entire volume of an interior of the liquid supply tube.

4. The liquid droplet ejecting apparatus according to claim 3, wherein the controller is configured to drive the ejecting pressure applying device to eject the liquid with an amount less than the entire volume of the interior of the liquid supply tube.

5. The liquid droplet ejecting apparatus according to claim 1, further comprising:

a gas permeable film which is disposed in a passage between the sub-tank and the suction pump so as to block the passage, the gas permeable film permitting permeation of the air more easily than the liquid.

6. The liquid droplet ejecting apparatus according to claim 5, wherein the main tank is a part of a plurality of main tanks mounted to the main tank mounting portion and the sub-tank is a part of a plurality of sub-tanks respectively corresponding to the plurality of main tanks;

wherein the passage of the ejecting head is a part of a plurality of passages respectively corresponding to the plurality of main tanks, and the ejecting pressure applying device is able to selectively apply the feed pressure to the liquid within the plurality of passages;

wherein the suction pump is connected to the plurality of sub-tanks; and wherein the controller is configured to drive the ejecting pressure applying device to eject from the nozzle the liquid inside the sub-tank corresponding to the main tank which has been detected by the main tank detector to be mounted to the main tank mounting portion.

7. The liquid droplet ejecting apparatus according to claim 1, wherein the controller is configured to start driving the ejecting pressure applying device after the controller starts driving the suction pump, when the main tank detector detects that the main tank is mounted to the main tank mounting portion.

8. The liquid droplet ejecting apparatus according to claim 1, further comprising:

a feed device which passes recording medium through an ejecting area where the liquid is ejected from the nozzle;

wherein the controller has a recording mode in which the ejecting pressure applying device causes the liquid to be ejected from the nozzle toward the recording medium when the feed device passes the recording medium through the ejecting area; and wherein the controller is configured to control the ejecting pressure applying device to eject the liquid from the nozzle with a diameter larger than a diameter of droplets of the liquid ejected in the recording mode, when the main tank detector detects that the main tank is mounted to the main tank mounting portion.

9. The liquid droplet ejecting apparatus according to claim 1, wherein the controller has a flushing mode in which the ejecting pressure applying device causes the liquid to be ejected forcibly from the nozzle; and wherein the controller is configured to control the ejecting pressure applying device to eject the liquid from the nozzle with a diameter larger than a diameter of droplets of the liquid ejected in the flushing mode, when the main tank detector detects that the main tank is mounted to the main tank mounting portion.

* * * * *